US005752732A

United States Patent [19]

Beaton et al.

[11] Patent Number: 5,752,732

[45] Date of Patent: May 19, 1998

[54] SELF-ADJUSTING BOTTLE CARRIER

[76] Inventors: Gary S. Beaton, 167 Georgetown Rd.; Thomas A. Beaton, 18 Upton La., both of Boxford, Mass. 01921; Tony Crisostomo, 43 Aborn St., Peabody, Mass. 01960

[21] Appl. No.: 711,108

[22] Filed: Sep. 9, 1996

[51] Int. Cl.[6] ..... B65D 23/10; B65G 7/12

[52] U.S. Cl. ..... 294/27.1; 294/169

[58] Field of Search ..... 294/15, 16, 27.1, 294/28, 31.1, 31.2, 34, 87.2, 87.22, 87.28, 90–92, 137, 164–169; 215/396, 397; 220/752, 759, 760, 765, 769, 773; D9/434, 455

[56] References Cited

U.S. PATENT DOCUMENTS

| | | | |
|---|---|---|---|
| D. 277,080 | 1/1985 | Gagnon | D9/434 |
| 1,190,607 | 7/1916 | Tarbet et al. | 294/27.1 X |
| 1,691,254 | 11/1928 | Robinson | 294/28 X |
| 2,534,512 | 12/1950 | Fulton | 294/28 |
| 2,563,351 | 8/1951 | Menser | 294/31.1 |
| 2,565,806 | 8/1951 | Fessner | 294/28 |
| 3,275,366 | 9/1966 | Hidding | 294/31.2 |
| 4,579,237 | 4/1986 | Gagnon | 215/396 |
| 5,085,477 | 2/1992 | Gagnon | 294/28 |

*Primary Examiner*—Johnny D. Cherry
*Attorney, Agent, or Firm*—John P. McGonagle

[57] ABSTRACT

A bottle carrier which has a self-adjusting angle between a hand portion and a cradle portion adapted to partially fit about and grasp the neck of a bottle. The carrier is comprised of a handle and a separate cradle element pivotally joined to the handle whereby the angle between the handle and the cradle is self-adjusting.

6 Claims, 5 Drawing Sheets

SELF-ADJUSTING BOTTLE CARRIER

BACKGROUND OF THE INVENTION

This invention relates generally to bottle carriers, and in particular to a self-adjusting bottle carrier for handling single large heavy bottles filled with water, chemicals, dairy products and the like.

Currently, more and more businesses and households are consuming bottled water because of the desire for pure clean water. Such water is commonly delivered in plastic five gallon bottles that weigh over forty pounds when full. Present day plastic five gallon bottles are constructed of resilient, thin-walled plastic. Although the plastic is strong, it does flex under stress.

Workmen delivering large numbers of bottles to commercial establishments and households have experienced a high frequency of hand, wrist and arm injuries. For this reason, the prior art has devised various handles which fit around the neck area of the bottle. These handles are designed to assist a workman in carrying and lifting large and heavy bottles. The most useful of the prior art handles provide a handle portion and cradle portion with an opening that closely fits around the bottle recessed neck area and are adapted to engage a bottle neck flange when lifted. Among the more useful prior art handles are U.S. Pat. Nos. 4,579,237; 3,520,570; Des. 334,142; Des. 317,843; and Des. 277,080.

The prior art handles referred to above are rigid and have set angles between the handle portion and cradle portion. This requires continuous manipulation of a workman's hand, wrist and arm when the workman is carrying a bottle to avoid a bottle swaying action. If an object as heavy as a filled five gallon bottle sways too much, the sway weight may cause the workman to drop the bottle or the bottle carrier to slip from the neck of the bottle. When the bottle weight is shifted to the neck area during lifting, the neck region flexes sometimes causing a prior art bottle carrier to slip from the neck of the bottle.

SUMMARY OF THE INVENTION

In view of the foregoing disadvantages inherent in the known types of devices now present in the prior art, the present invention provides a bottle carrier which is self-adjusting. As such, the general purpose of the present invention, which will be described subsequently in greater detail, is to provide a new and improved bottle carrier which has a self-adjusting angle between a hand portion and a cradle portion.

To attain this, the present invention provides a handle and a separate cradle element pivotally joined to said handle whereby the angle between said handle and said cradle are self-adjusting.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 2:
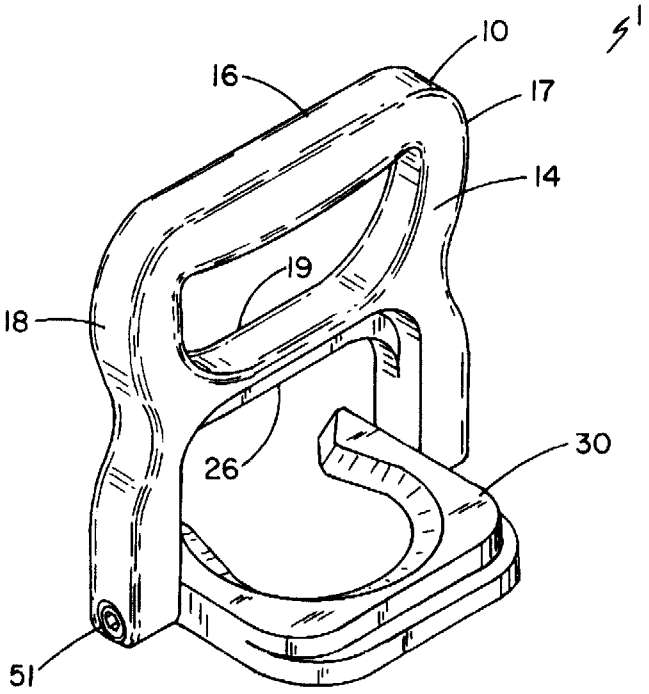
FIG. 2 is a close-up view of the invention illustrated in FIG. 1.
Figure 1:
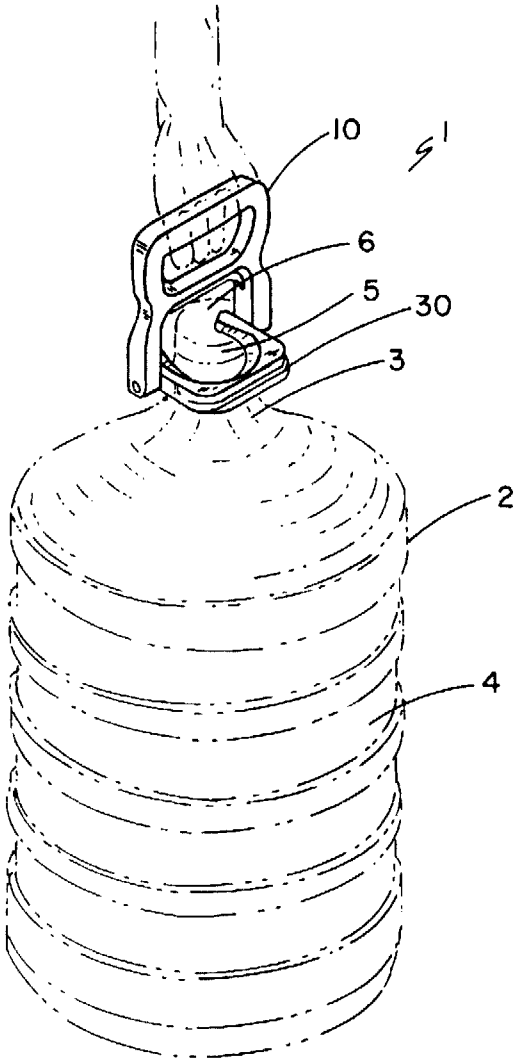
FIG. 1 is a rear perspective view of the invention engaging a five gallon bottle.
Figure 3B:
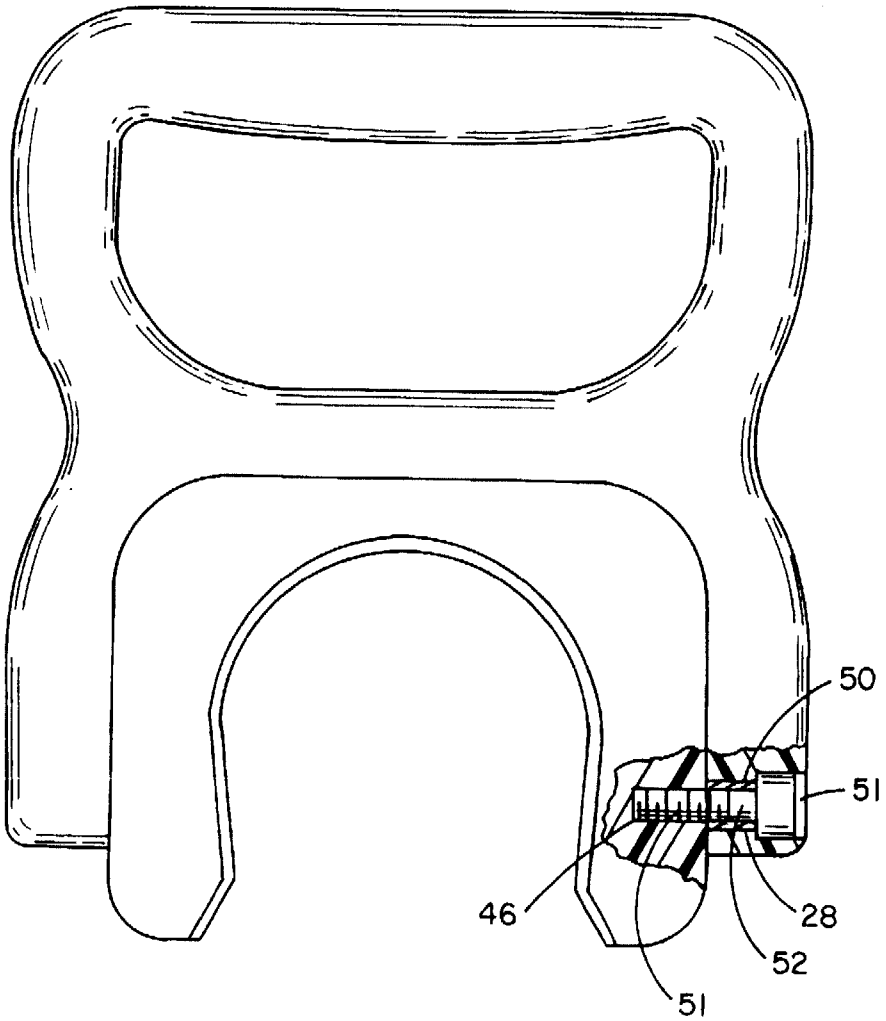
FIG. 3B is a close up view of the invention illustrated in FIG. 3A, partly in section.
Figure 3A:
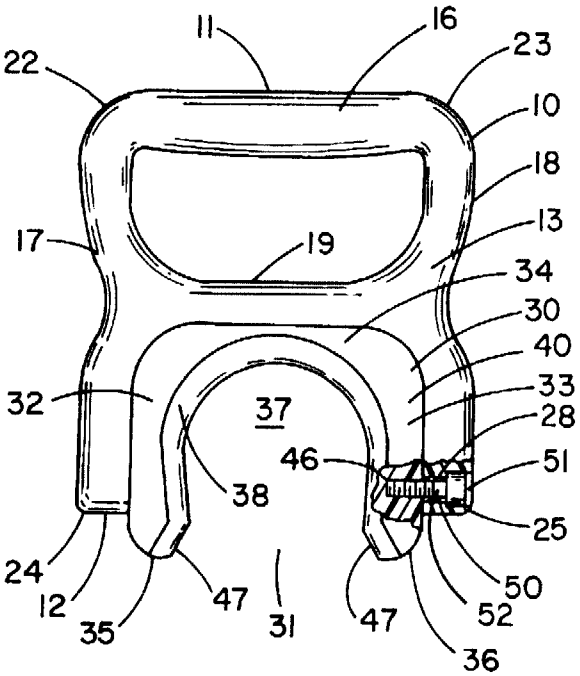
FIG. 3A is a front view of the invention with the cradle element folded into the handle.
Figure 5:
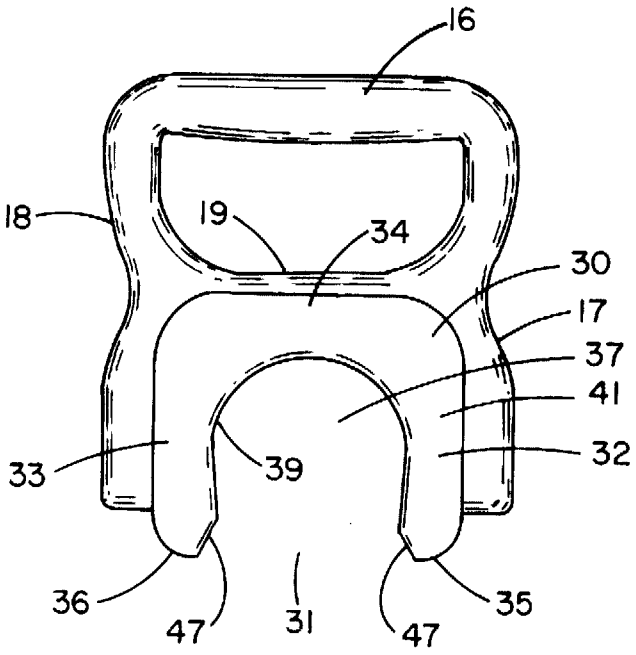
FIG. 5 is a rear view thereof.
Figure 4:
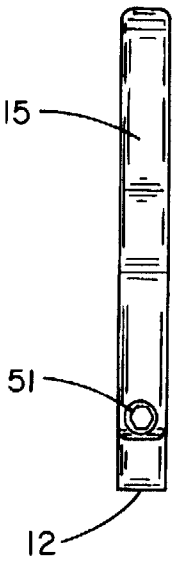
FIG. 4 is a side view thereof.
Figure 6:
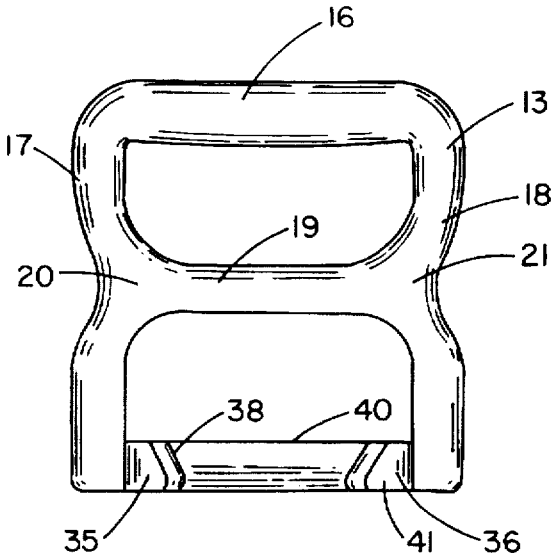
FIG. 6 is a front view of the invention with the cradle element extended 90° from the handle.
Figure 7:
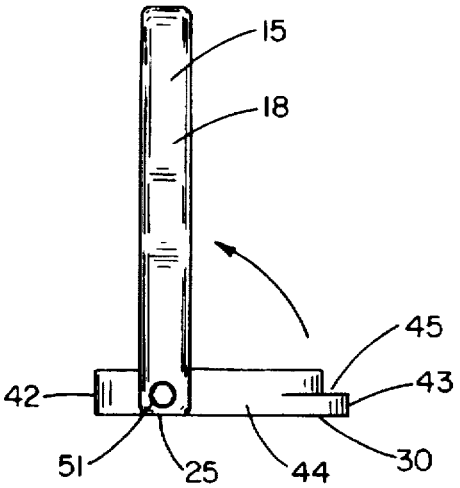
FIG. 7 is a side view thereof.
Figure 8:
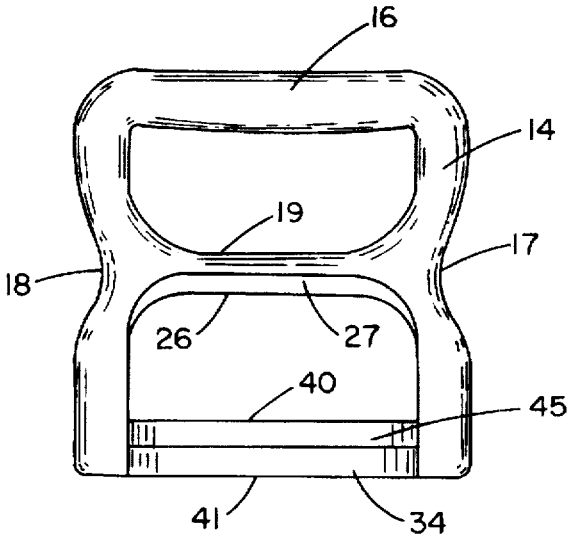
FIG. 8 is a rear view thereof.
Figure 9:
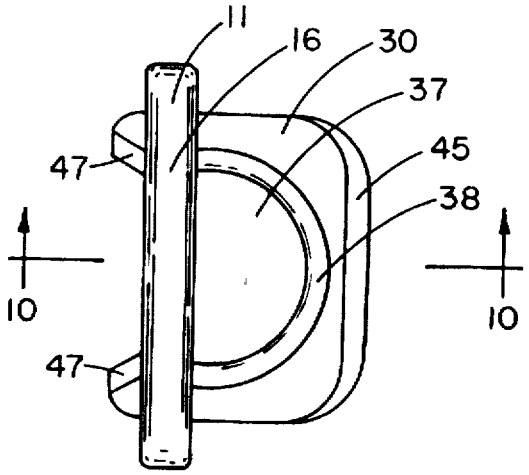
FIG. 9 is a top view thereof.
Figure 10:
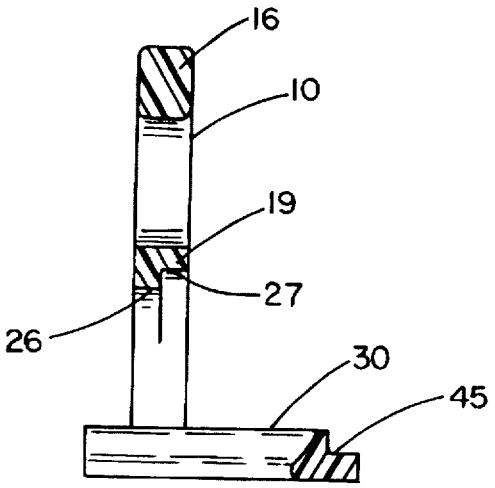
FIG. 10 is a section view along the lines 10—10 of FIG. 9.

Referring to the drawings in detail wherein like elements are indicated by like numerals, there is shown a self-adjusting bottle carrier 1 incorporating the features of the present invention. A typical bottle 2 has a narrow neck 3 and an enlarged body portion 4. The neck 3 generally has one or more annular flanges 5 situated thereon near to the top 6 of the bottle 2. For reference purposes, it should be noted that a typical bottle 2 would contain five or more gallons of water and weigh forty or more pounds. The carrier 1 is comprised of a handle portion 10 and a cradle element 30. The cradle element 30 is adapted to partially fit about and grasp the neck 3 of a bottle 2, underneath the topmost neck flange 5. The cradle element 30 is pivotally connected to said handle portion 10.

The handle portion 10 has a top 11, bottom 12, front 13, rear 14 and two sides 15. The handle portion 10 is comprised of a grasping bar 16 forming the handle portion top 11, said grasping bar 16 having opposing, downwardly extending side members 17, 18 forming the handle portion sides 15. The handle portion 10 is further comprised of a cross-member 19 attached to the inner mid-point surfaces 20, 21 of the opposing side members 17, 18, said cross-member 19 being generally parallel to said grasping bar 16. The side members 17, 18 have tops 22, 23 and bottoms 24, 25, said tops 22, 23 terminating in the grasping bar 16. The cross-member 19 has a ridge 26 formed along its bottom side 27, said ridge 26 being flush with the handle portion front 13 and extending rearwardly toward the handle portion rear 14 approximately one-half the rear-to-front thickness of the cross-member 19.

The cradle element 30 has a yoke-like shape formed by left 32 and right legs 33 joined to a rear brace piece 34, said cradle element 30 having an upper surface 40, lower surface 41, front 42, rear 43, and two sides 44. Each leg 32, 33 has a front tip 35, 36 with a separation therebetween forming a front opening 31 for the cradle element 30. The legs 32, 33 and rear brace piece 34 define a U-shaped open area 37 adapted to engage the neck 3 of a bottle 2, said open area 37 being accessible via said front opening 31. To assist in placing the cradle element 30 about the neck 3 of a bottle 2, The inner surfaces 47 of the front tips 35, 36 are bevelled. The inner and upper surfaces 38 of the legs 32, 33 and rear brace piece 34 are also bevelled to provide clearance and non-interference with any bottle caps. The inner and lower surfaces 39 of the legs 32, 33 and rear brace piece 34 are curved to provide a better fit about the bottle neck 3 and lessen deformation of the bottle neck thereby reducing the risk of the invention 1 slipping from the bottle 2. The rear brace piece 34 has a channel 45 with a rectangular cross-section formed at the junction of its rear and top surface. The channel 45 cross-section dimensions correspond with the dimensions of the handle ridge 26.

Each of the handle portion side members 17, 18 has a side-to-side aperture 28 formed therein near to the side member bottoms 24, 25. Each of the cradle element legs 32, 33 has a side-to-side aperture 46 formed therein near to the legs' front tips 35, 36. The cradle element 30 is fitted within the handle portion side members 17, 18 so that the cradle element apertures 46 are aligned with the handle portion apertures 28. A fastening screw 51 is inserted into each handle portion aperture 28 and through to and engaging a corresponding cradle element aperture 46. A bushing 50 is fitted over the shoulder portion 52 of the screw 51 within each handle portion aperture 28. The screw shoulder portion 52 is thereby free to rotate within the bushing 50 while still providing a load-bearing element for the invention 1.

It is understood that the above-described embodiment is merely illustrative of the application. Other embodiments may be readily devised by those skilled in the art which will embody the principles of the invention and fall within the spirit and scope thereof.

We claim:

1. A self-adjusting bottle carrier for use with a bottle having a narrow neck and an enlarged body portion, said bottle neck having one or more annular flanges situated thereon near to the top of the bottle, comprising:

a handle portion having a top, bottom, front, rear and two sides, said handle portion being comprised of a grasping bar forming the handle portion top, said grasping bar having opposing, downwardly extending side members forming the handle portion sides and having inner mid-point surfaces, said handle portion being further comprised of a cross-member attached to the inner mid-point surfaces of the side members, said cross-member being generally parallel to said grasping bar; and a cradle element pivotally connected to said handle portion, said the cradle element has a yoke-like shape formed by left and right legs joined to a rear brace piece, said cradle element having an upper surface, lower surface, front, rear, and two sides, each said leg having a front tip forming a front opening for the cradle element, said legs and rear brace piece defining a U-shaped open area for receiving the neck of a bottle, said open area being accessible via said front opening, said rear brace piece having a rear surface and a top surface, said front tips each having a bevelled inner surface, said legs and rear brace piece having bevelled inner and upper surfaces, wherein the inner and lower surfaces of the leas and rear brace piece are curved, wherein the rear brace piece has a channel with a rectangular cross-section formed at the junction of its rear and top surface.

2. A self-adjusting bottle carrier as recited in claim 1, wherein:

the cross-member has a bottom side with a ridge formed thereon, said ridge being flush with the handle portion front and extending rearwardly toward the handle portion rear approximately one-half the rear-to-front thickness of the cross-member.

3. A self-adjusting bottle carrier as recited in claim 2, wherein:

the channel cross-section dimensions correspond with the dimensions of the said ridge.

4. A self-adjusting bottle carrier as recited in claim 3, wherein said connection between said cradle element and said handle portion is comprised of:

a side-to-side aperture formed in each of the handle portion side members near to the side member bottoms;

a side-to-side aperture formed in each of the cradle element legs near to the legs' front tips;

said cradle element being fitted within the handle portion side members wherein the cradle element apertures are aligned with the handle portion apertures; and a fastening screw inserted into each handle portion aperture and through to and engaging a corresponding cradle element aperture.

5. A self-adjusting bottle carrier as recited in claim 4, wherein said connection between said cradle element and said handle portion is further comprised of:

a bushing fitted over a shoulder portion of the screw within each handle portion aperture, said screw shoulder portion thereby being free to rotate within said bushing while still providing a load-bearing element.

6. A self-adjusting bottle carrier as recited in claim 5, wherein:

said handle portion side members have tops and bottoms, said tops terminating in said grasping bar.

* * * * *